United States Patent [19]

Fischer

[11] 4,171,590

[45] Oct. 23, 1979

[54] ASSEMBLY KIT FOR MAKING STRUCTURAL ELEMENT

[76] Inventor: Artur Fischer, Weinhalde 34, D-7244 Waldachtal 3 (Tumlingen), Fed. Rep. of Germany

[21] Appl. No.: 870,855

[22] Filed: Jan. 19, 1978

[30] Foreign Application Priority Data

Jan. 27, 1977 [DE] Fed. Rep. of Germany ..... 2703237
Mar. 10, 1977 [DE] Fed. Rep. of Germany ..... 2710392

[51] Int. Cl.[2] ..... A63H 33/04

[52] U.S. Cl. ..... 46/23; 46/27; 46/29

[58] Field of Search ..... 46/16, 17, 23, 25, 26, 46/28, 29, 31, 27

[56] References Cited

U.S. PATENT DOCUMENTS

| | | | |
|---|---|---|---|
| 2,587,798 | 3/1952 | Wilcox | 46/31 X |
| 2,949,306 | 8/1960 | Gitelson et al. | 46/31 UX |
| 2,981,997 | 5/1961 | Painter | 46/16 X |
| 3,460,282 | 8/1969 | Swirsky | 46/31 UX |
| 3,645,036 | 2/1972 | Biesterfeld et al. | 46/23 |
| 3,659,376 | 5/1972 | Fischer | 46/31 |
| 3,670,449 | 6/1972 | Lemkin et al. | 46/23 |

FOREIGN PATENT DOCUMENTS

| | | | |
|---|---|---|---|
| 164187 | 10/1949 | Austria | 46/29 |

*Primary Examiner*—F. Barry Shay

*Attorney, Agent, or Firm*—Michael J. Striker

[57] ABSTRACT

An assembly kit has a structural element having two elongated leg portions, and a hinge portion pivotally connecting the leg portions with one another in a direction of elongation thereof and together with the leg portions forming an integral member. Means is provided for connecting the structural element with another structural element. Two such structural elements may be located laterally adjacent to one another and connected with one another by a plate-like connecting piece which overlaps juxtaposed end sections of the structural element and is connected with the latter by the connecting means. Three such structural elements may be located relative to one another so as to form a substantially triangular hollow support element, and a substantially triangular connecting piece may be inserted in a hollow of the support element and connected with the structural elements by the connecting means. The connecting means may include openings formed in the structural elements and adapted to be aligned with openings formed in the connecting piece. Connecting members such as pins or bolts may be inserted in the thus-aligned openings so as to connect the structural elements with the connecting piece. The connecting members may have head portions which are recessed in the respective openings and may be flush with outer surfaces of the structural elements.

19 Claims, 3 Drawing Figures

ASSEMBLY KIT FOR MAKING STRUCTURAL ELEMENT

BACKGROUND OF THE INVENTION

The present invention relates to an assembly kit and to a structural element of the assembly kit. More particularly, it relates to such a structural element which has two elongated leg portions connected with one another in the direction of elongation thereof, and provided with means for connecting the structural element to another structural element.

Structural elements have been proposed in the art, having elongated leg portions rigidly connected with one another and connecting means formed as openings each having two extensions located opposite to one another. The leg portions of the structural element enclose a right angle with one another. Such structural elements give a possibility to assemble in a simple manner quadrangular or rectangular supports for toy models such as cranes, towers and the like. In the field of actual structures, however, triangular supports are often used. In the field of toy models it is also required to provide such structural elements which enables the user to assemble triangular supports. In the field of actual structures the structural elements are formed as corner members having leg portions rigidly connected and enclosing a particular angle with one another. Generally it would be possible to use such structural elements for assembling toy models, however, these structural elements have a disadvantage that each corner element can be used only for assembling of a predetermined triangular support. Such limited capability of the structural elements for assembling the supports makes these structural elements inapplicable for assembly kits in view of economy considerations.

SUMMARY OF THE INVENTION

Accordingly, it is an object of the present invention to provide an assembly kit and a structural element which avoids the disadvantages of the prior art.

More particularly, it is an object of the present invention to provide a structural element and an assembly kit which gives a user a possibility of assembling supporting elements having different forms.

Another object of the present invention is to provide an assembly kit and a structural element which gives a user the possibility of assembling support elements having a triangular configuration.

In keeping with these objects, and with others which will become apparent hereinafter, one feature of the present invention, briefly stated, is that an assembly kit, in accordance with the invention, comprises a structural element having two elongated leg portions, and a hinge portion pivotally connecting the leg portions with one another in a direction of elongation thereof and together with said leg portions forming an integral member. Means are provided for connecting the structural element with another structural element. In the thus constructed structural element it is possible to place the leg portions in any desirable angular position relative to one another. When several such structural elements are located adjacent to one another and connected with one another by the connecting means such as trusses extending in a direction transverse to a direction of elongation of the structural elements, fixation of the angular position of the leg portions of the structural elements is not necessary. Various triangular configurations of the support can be obtained by various angular positions of the leg portions of the structural elements and also by various lengths of the trusses connecting the structural elements with one another. It is to be understood that the structural elements in accordance with the present invention can be also used for assembling not only the triangular supports but also the supports having rectangular, quadrangular or trapezoidal form. The leg portions of the structural elements pivotal relative to one another give a possibility of manufacture of pivotal connections such as for assembling drawbridges.

Another feature of the present invention is that the structural elements may be positioned laterally adjacent to one another and connected with one another in this position by a plate-like connecting piece which has end sections overlapping and connected to juxtaposed end sections of the structural elements. The connecting piece does not affect pivotability of the elongated leg portions of the structural elements, so that this connection of two structural elements with one another is especially suitable for assembling purposes. In this case an unbreakable stretchable butt connection is formed wherein the structural elements are positioned in alignment with one another. In order to make possible a relative location of the leg portions of the structural elements at an acute angle, especially when the structural elements have small dimensions, it is advantageous to provide a bevel in an inner surface of the longitudinal edges of the connecting pieces.

Still another feature of the present invention is that several structural elements may be located relative to one another so as to form a hollow support, and a connecting piece having a cross section corresponding to a cross section of a hollow of the support is inserted into the hollow and connected with the structural element. A configuration of the support is here defined by the configuration of the connecting piece whose outer contour corresponds to the inner contour of the support. When several structural elements, for instance three structural elements, are positioned on the connecting piece of the triangular configuration the structural elements form the support of also the triangular configuration corresponding to the configuration of the connecting piece. For fixation the structural elements in this angular position can be connected with the connecting piece for instance by lock bolts extending through openings provided in the connecting piece. For fixation of the configuration of the support it is sufficient to provide two such lock bolts located at both ends of the connecting piece. In order to improve rigidity of the connection an additional transverse truss member may be provided in a central portion of the thus-formed support.

A further feature of the present invention is that the connecting piece may be formed as a hollow member having two ends spaced from one another in the direction of elongation thereof, and a transverse wall may be provided at one of these ends and may have an opening. This wall serves, on the one hand, for reinforcing of the connecting piece, and also serves, on the other hand for forming a carrying side face of the connecting piece. This wall gives a possibility to insert in the hole, cables or ropes for a crane winch.

A still further feature of the present invention is that the connecting piece is provided for at least four connecting formations for forming butt connections of the structural elements with one another. In order to form the butt connection of the supports with one another one half of the connecting piece is inserted in one support, and another half of the connecting piece is inserted in another support located laterally adjacent the one support. Each of the structural elements forming the supports can be rigidly connected with respective portions of the connecting piece by the connecting means. The connecting formation may be arranged in pairs spaced from one another in the direction of elongation of the structural elements.

An additional feature of the present invention is that connecting members for connecting the structural elements with the connecting piece may be fully recessed in openings formed in the structural elements. Head portions of the connecting members may have outer surfaces which are flush with outer surfaces of the structural elements. In such case all the outer surfaces of the structural elements are smooth so that additional structural elements can be shifted over the thus-assembled supports so as to form for instance a crane beam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
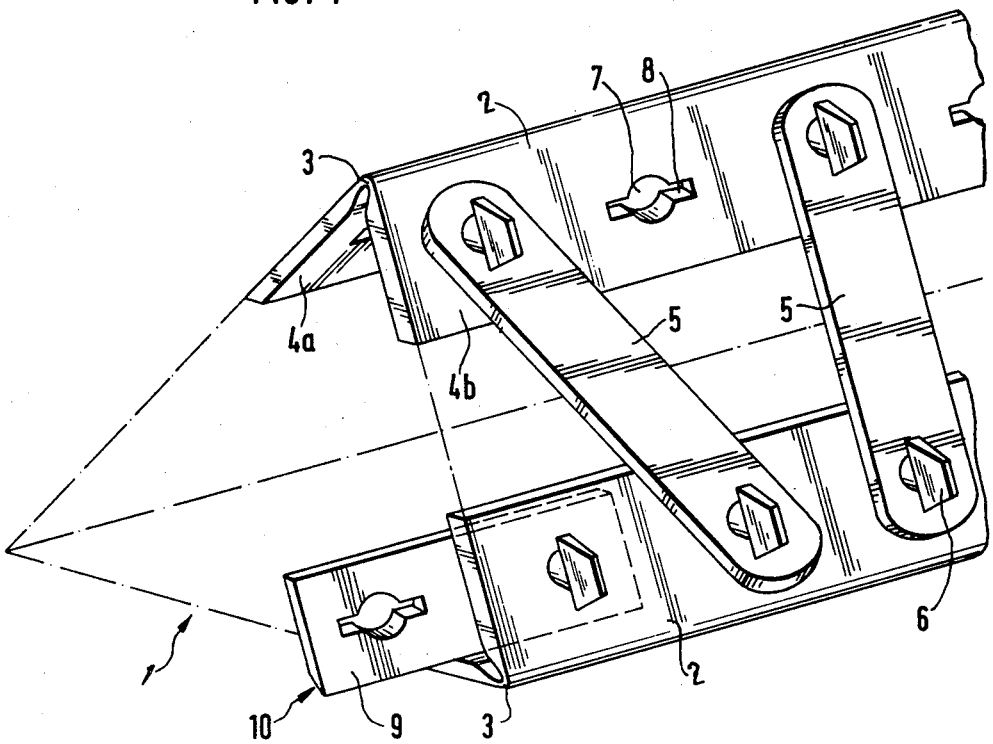
FIG. 1 is a perspective view showing a portion of a support formed by structural elements in accordance with the present invention.

The support 1 is formed by three structural elements formed as corner elements 2 constituted of synthetic plastic material. Only two such structural elements are shown in FIG. 1 for the sake of clarity. Each of the structural elements have two elongated leg portions 4*a* and 4*b* connected with one another in the direction of elongation by a hinge portion 3. The leg portions 4*a* and 4*b* together with the hinge portion 3 form an integral member. The hinge portion 3 gives the leg portions 4*a* and 4*b* a possibility to be pivoted so as to assume any angular position relative to one another. Fixation of the angular position of the leg portions is attained by connecting elements such as trusses. An individual truss 5 is connected with the structural element formed as the corner element 2 by connecting locking member 6 such as a lock pin or lock bolt. The locking member 6 extends through an opening 7 provided in the leg portions 4*a* and 4*b* and in the truss 5, and then is locked by rotation through 90°. For this purpose the opening 7 has two extensions 8 located opposite to one another, through which the locking portion of the locking element 6 passes in a respective position thereof.

In order to increase a longitudinal dimension of the support the corner elements can be connected with other structural elements by means of connecting pieces 9. The structural elements to be connected are located laterally adjacent to one another and in alignment with one another and connected by the connecting piece 9 overlapping juxtaposed end portions of the structural elements. The connecting pieces 9 are connected with the respective structural elements by the members 6. In order to position the leg portions of the structural elements at an acute angle relative to one another especially in the case when the structural elements have small dimensions, it is possible to form bevels 10 in inner longitudinal edges of the connecting pieces 9.

In order to form a support having a configuration shown in FIG. 2, the structural elements 2 are placed on a hollow connecting piece 11 and fixedly connected with the later by the locking element 6. The cross section of the connecting piece 11 has a shape corresponding to the shape of the support. In order to form the supports with various shapes it is necessary to provide the connecting pieces having the respective shapes of the cross sections thereof. Fixation of the support and the connecting piece 11 and the rigid connection of the structural elements 2 with the connecting piece form an extremely rigid connection.

Figure 2:
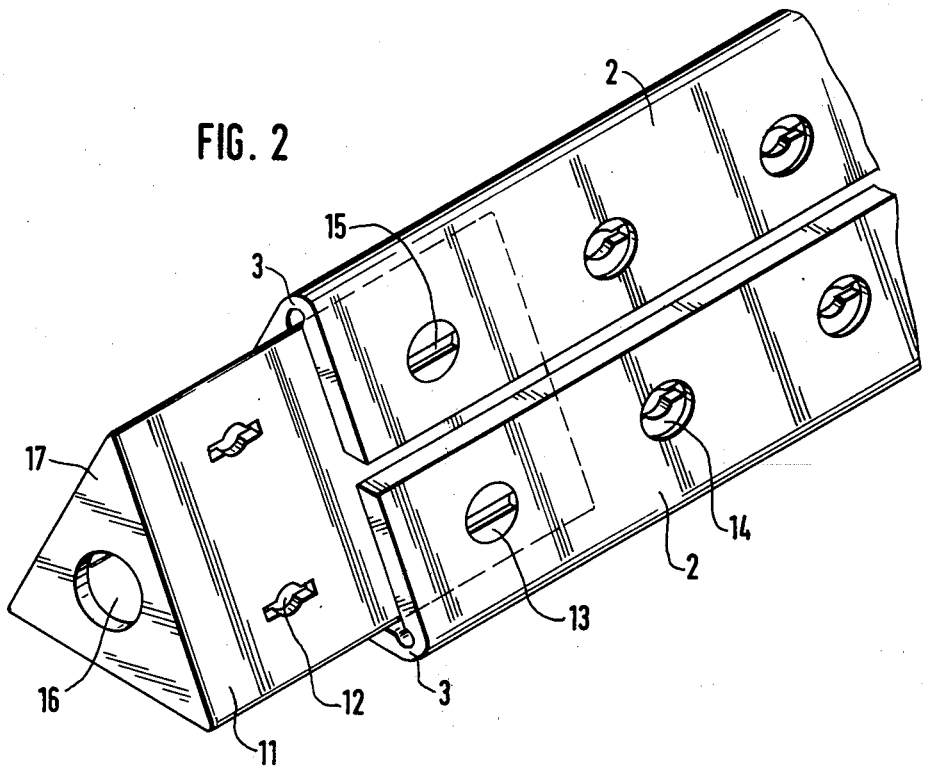
FIG. 2 is a perspective view showing a portion of a support formed by structural elements connected with one another by a triangular connecting piece in accordance with the present invention.
Figure 3:
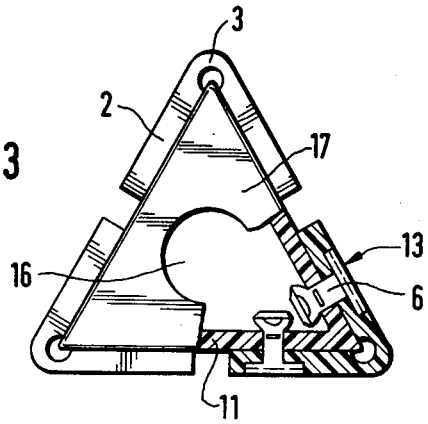
FIG. 3 is a partially sectioned front view of the support shown in FIG. 2.

In order to increase the longitudinal dimensions of the support 1 the structural elements 2 shown in FIG. 2 are connected with other structural elements located laterally adjacent to the former and connected with the same by a butt connection. For this reason the connecting piece 11 has four connecting formations 12 arranged in pairs which are spaced from one another in the direction of elongation of the connecting piece 11. One half of the connecting piece 11 is inserted in the structural elements shown in FIG. 2 whereas the other half of the connecting piece 11 is inserted in the laterally adjacent structural elements which are not shown in the drawing.

In order to permit another support to be shifted over the support shown in FIG. 2, the locking elements 6 have heads 13 which have flat outer surfaces and are recessed in openings 14 of the structural elements 2. The heads 13 have slots 14 for rotating the locking elements.

In order to laterally close and to reinforce the connecting piece 11 a side wall 17 is provided. The wall has a bore 16 which serves for passing cables, ropes and the like therethrough. For closing a connecting piece forming a support two connecting formations are sufficient for each face of the structure.

It will be understood that each of the elements described above, or two or more together, may also find a useful application in other types of constructions differing from the types described above.

While the invention has been illustrated and described as embodied in an assembly kit and a structural element, it is not intended so be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An assembly kit, comprising at least three structural elements each having two elongated leg portions and a hinge portion pivotally connecting said leg portions with one another in a direction of elongation thereof and together with said leg portions forming an integral member, said structural elements being located relative to one another so as to form at least a substantially triangular hollow support element for a toy model; and means for connecting said structural elements with one another comprising a connecting piece having a cross section corresponding to an inner cross section of the hollow of said support element, said connecting means further including means for securing said structural elements to said connecting piece, and cooperating connecting portions formed in said structural elements and said connecting piece.

2. The assembly kit as defined in claim 1, wherein said securing means includes openings formed in said leg portions and connecting members insertable in said openings.

3. The assembly kit as defined in claim 2, wherein said connecting members are lock pins.

4. The assembly kit as defined in claim 2, wherein said connecting members are lock bolts.

5. The assembly kit as defined in claim 1, wherein said structural element is constituted of a synthetic plastic material.

6. The assembly kit as defined in claim 1, wherein said hinge portion is film-like.

7. The assembly kit as defined in claim 1, wherein said hinge portion is an integral portion extending in the direction of elongation of said leg portions and connecting the latter over the entire length thereof.

8. The assembly kit as defined in claim 1; and further comprising another such structural element adapted to be laterally aligned with at least one of said first-mentioned structural elements, said securing means connecting said other and one structural elements to said connecting piece in an aligned condition.

9. The assembly kit as defined in claim 8, wherein said connecting piece is an elongated member of a trianguler cross-section.

10. The assembly kit as defined in claim 9, wherein each of said leg portions of said structural elements has end sections spaced from one another in the direction of elongation thereof, said connecting piece having further end sections adapted to lay on and to overlap said end sections of said leg portions of said other and one structural elements in the aligned position, said securing means connecting said end sections of said leg portions of said other and one structural elements with said further end sections of said connecting piece.

11. The assembly kit as defined in claim 1, wherein said connecting piece is hollow.

12. The assembly kit as defined in claim 1, wherein said structural elements together form a support element of a toy crane model.

13. The assembly kit as defined in claim 1, wherein said structural elements together form a support element of a toy bridge model.

14. The assembly kit as defined in claim 1, wherein said connecting piece is elongated and has two ends spaced from one another in the direction of elongation thereof, said connecting piece having a side wall located in the region of one of said ends thereof and having a bore.

15. The assembly kit as defined in claim 1, wherein said connecting piece has further securing means adapted to be aligned with said first-mentioned securing means so that said structural elements can be connected with said connecting piece in an aligned position of said first-mentioned securing means and said further securing means.

16. The assembly kit as defined in claim 15, wherein said further securing means of said connecting piece includes at least four connecting formations.

17. The assembly kit as defined in claim 16, wherein said connecting piece is elongated and said connecting formations are arranged in pairs spaced from one another in the direction of elongation of said connecting piece.

18. The assembly kit as defined in claim 15, wherein said further securing means of said connecting piece includes openings, said securing means of said structural elements including further openings adapted to align with said openings of said connecting piece, and connecting members insertable in the thus-aligned openings, said connecting members having head portions facing away from said hollow of said support element and recessed in said further openings of said structural elements in a connected condition.

19. The assembly kit as defined in claim 18, wherein said structural elements and said head portions of said connecting members have outer surfaces facing away from said hollow of said support element in the connected condition, said outer surfaces of said head portions of said connecting members being flush with said outer surfaces of a respective structural element in the connected condition.

* * * * *